US010099848B2

(12) United States Patent
Heydel et al.

(10) Patent No.: US 10,099,848 B2
(45) Date of Patent: Oct. 16, 2018

(54) CAPSULE FOR FOOD OR BEVERAGE PREPARATION

(71) Applicant: NESTEC S.A., Vevey (CH)

(72) Inventors: Christophe Heydel, Chez le Bart (CH); Christian Talon, Vufflens-le-Chateau (CH)

(73) Assignee: Nestec S.A., Vevey (CH)

( * ) Notice: Subject to any disclaimer, the term of this patent is extended or adjusted under 35 U.S.C. 154(b) by 354 days.

(21) Appl. No.: 14/897,301

(22) PCT Filed: Jun. 3, 2014

(86) PCT No.: PCT/EP2014/061464

§ 371 (c)(1),
(2) Date: Dec. 10, 2015

(87) PCT Pub. No.: WO2014/198586

PCT Pub. Date: Dec. 18, 2014

(65) Prior Publication Data

US 2016/0137401 A1 May 19, 2016

(30) Foreign Application Priority Data

Jun. 11, 2013 (EP) ..... 13171462

(51) Int. Cl.
*B65D 85/804* (2006.01)

(52) U.S. Cl.
CPC ..... *B65D 85/8043* (2013.01)

(58) Field of Classification Search
CPC .. A47J 31/407; A47J 31/0678; B65D 85/8043
See application file for complete search history.

(56) References Cited

U.S. PATENT DOCUMENTS

2003/0181786 A1* 9/2003 Heimberger ..... A61B 1/00068 600/159
2007/0068395 A1* 3/2007 Masek ..... B65D 85/8043 99/295

FOREIGN PATENT DOCUMENTS

| | | |
|---|---|---|
| DE | 102011012881 | 3/2012 |
| EP | 2562101 | 2/2013 |
| WO | 03073896 | 9/2003 |

* cited by examiner

*Primary Examiner* — Erik Kashnikow
*Assistant Examiner* — Lela S. Williams
(74) *Attorney, Agent, or Firm* — K&L Gates LLP

(57) ABSTRACT

A food or beverage capsule (200), comprises: •a capsule body (201) comprising a cavity (202) and an open end (204) in communication with the cavity (202); •an injection wall (205) disposed upon the open end (204) so as to enclose the cavity (202), the injection wall (205) thereby comprising an interior side (206) facing the cavity (202); and •a quantity of a food or beverage ingredient disposed within the cavity (202). The capsule (200) further comprises a sealing membrane (207) fabricated from a flexible material and disposed upon the interior side (206) of the injection wall (205), the sealing membrane (207) being attached to the interior side (206) of the injection wall (205) over at least one fixed region (208) of the sealing membrane (207), at least one free region (209) of the sealing membrane (207) extending freely from an edge of said at least one fixed region (208).

15 Claims, 5 Drawing Sheets

CAPSULE FOR FOOD OR BEVERAGE PREPARATION

CROSS REFERENCE TO RELATED APPLICATIONS

The present application is a National Stage of International Application No. PCT/EP2014/061464, filed on Jun. 3, 2014, which claims priority to European Patent Application No. 13171462.8, filed Jun. 11, 2013, the entire contents of which are being incorporated herein by reference.

FIELD OF THE INVENTION

The present invention concerns a capsule for containing a food precursor, suitable for use with a food preparation machine.

BACKGROUND OF THE INVENTION

Beverage preparation machines are well known in the food industry and consumer goods domain. Such machines allow a consumer to prepare on command a single serving of a beverage such as brewed coffee, espresso coffee, tea, hot chocolate drink, or the like.

Most beverage preparation machines for in-home use operate according to a system in which beverage ingredients are provided as individually-packaged, single-serving portions. Such portions can be soft pods, pads, or sachets, but increasingly more systems use semi-rigid or rigid portions such as rigid pods or capsules. In the following, it should be understood that the beverage machine in question is a beverage preparation machine working with a rigid or semi-rigid capsule.

In many instances, the capsules for use in beverage preparation machines are sealed. Such sealed capsules are advantageous in that they protect the ingredient contained therein from the surrounding atmosphere, improving the shelf life of the capsule. Typically, such closed capsules are made from a gas and/or moisture impermeable material, and feature a rigid or semi-rigid body having one of its walls made from a flexible membrane.

The beverage is prepared by inserting the capsule into a beverage machine, which preferably comprises a receptacle for accommodating said capsule and a fluid injection system for injecting a fluid (preferably water) under pressure into said capsule. In most applications, the water injected into the capsule under pressure is heated, generally to a temperature above 70° C. However, in some particular instances it may be advantageous to inject tepid or chilled water instead. The pressure inside the capsule chamber during extraction and/or dissolution of the capsule contents is typically about 1 to about 8 bar for dissolution products and about 2 to about 12 bar for extraction of roast and ground coffee.

The present invention could also encompass the so-called "brewing" process of beverage preparation particularly for tea and coffee. Brewing involves the infusion over time of the ingredient in a fluid, most commonly hot water, whereas extraction or dissolution preparations produce a beverage within a few seconds.

For purposes of clarity, however, in this document the term "brewing" of an ingredient by a fluid is understood to encompass extraction of a powdered edible material (e.g. roast and ground powdered coffee), dissolution of edible soluble material (e.g. soluble tea, coffee, milk, or cocoa), or the infusion of an edible material in an infusion fluid under very low or atmospheric pressure, for a longer time than that required for extraction or dissolution (e.g. tea leaves in hot water).

The principle of extracting and/or dissolving the contents of a closed capsule under pressure is known and consists typically of confining the capsule in a receptacle of a machine, injecting a quantity of pressurized water into the capsule to extract or dissolve the substance, and then dispensing the resulting beverage from the capsule.

The injection is generally performed by piercing a face of the capsule with a piercing injection element, such as a fluid injection needle incorporated into the machine. Capsules applying this principle have already been described, for example in applicant's European patent n° EP 1 472 156 B1, and in EP 1 784 344 B1.

In addition, machines applying this principle have already been described for example in patents CH 605 293 and EP 242 556. According to these documents, the machine comprises a receptacle for the capsule, and a perforation and injection element made in the form of a hollow needle comprising in its distal region one or more liquid injection orifices. The needle has a dual function in that it simultaneously opens the top portion of the capsule while providing an inlet channel into the capsule for the injection of the water.

The machine comprises a supply of the fluid (usually water) that is used to prepare the beverage from the ingredient(s) contained in the capsule. The machine further comprises a heating unit such as a boiler or a heat exchanger, which heats the water used therein to working temperatures (usually between 80° and 90° C.). Finally, the machine comprises a pump for circulating the water from the tank to the capsule, optionally though the heating unit. The circulation of the water within the machine may be directed via a selecting valve means, such as for instance a peristaltic valve of the type described in applicant's European patent application EP 2162653 A1.

Such systems are particularly well-adapted to the preparation of coffee. One configuration for achieving this which is particularly advantageous is to provide a capsule containing roast and ground coffee powder, which is extracted with hot water injected therein.

Capsules have been developed for such an application, which are described and claimed in applicant's European patent EP 1 784 344 B1, or in European patent application EP 2 062 831.

In short, such capsules typically comprise:

- a hollow body and an injection wall which are impermeable to liquids and to air, the wall being attached to the body and adapted to be punctured by e.g. an injection needle of the machine;
- a chamber containing a bed of roast and ground coffee to be extracted;
- an aluminium membrane disposed at the bottom end of the chamber for retaining the internal pressure therein, the membrane being associated with piercing means which create drainage holes in the aluminium membrane when the internal pressure inside the chamber reaches a certain pre-determined value; and
- optionally, a deflection means configured to break up the jet of fluid, thereby reducing the speed of the jet of fluid injected into the capsule and evenly distributing the fluid across the bed of substance at a reduced speed.

During extraction, the beverage capsule is pierced by the fluid injection needle of the beverage preparation machine, usually in the aluminium membrane. The liquid is injected in the capsule compartment and the pressure within the capsule increases, facilitating the extraction of the beverage from the ingredients contained within the capsule.

In some implementations, the beverage machine also pierces the capsule at a second location, for instance at its bottom, permitting the beverage to flow out during the operation of the machine. In others, the beverage capsule may be provided with a spout or drain, to which is generally affixed a valve or a membrane that opens when the pressure within the capsule builds up to the level required for proper beverage preparation.

In the prior art capsules, when the fluid injection needle of the machine is removed from the capsule, after the beverage has been prepared and dispensed, the capsule top membrane is pierced and a hole "H" remains as illustrated in FIG. 1. However, in such a case, a residual pressure "P" remains within the capsule compartment due to gas that may remain trapped within the capsule under pressure.

When the capsule contains soluble ingredient to extract, the capsule compartment generally comprises a single cavity, and the residual fluid pressure is distributed across the compartment volume.

In all cases, the residual pressure P may cause a jet of liquid "J"—often referred to as "backflow"—to spray out of the hole H. Such a backflow is represented in FIG. 1. Although such a phenomenon occurs infrequently, it is undesirable to permit hot liquid to spout from the capsule. Moreover, such leakage may contain beverage ingredients, which will negatively affect the cleanliness of the beverage machine and its operation.

It is therefore an object of the invention to furnish a means for preventing backflow in a beverage capsule, in particular which is simple in construction and inexpensive to implement.

SUMMARY OF THE INVENTION

The invention is therefore drawn to a food or beverage capsule, comprising a capsule body, said capsule body being preferably substantially cup-shaped, and comprising a cavity and an open end in communication with said cavity; an injection wall disposed upon said open end so as to enclose said cavity, said injection wall thereby comprising an interior side facing said cavity; and a quantity of a food or beverage ingredient disposed within said cavity.

According to the invention, said food or beverage capsule further comprises a sealing membrane fabricated from a flexible material and disposed upon said interior side of said injection wall, said sealing membrane being attached to said interior side of said injection wall over at least one fixed region of said sealing membrane, at least one free region of said sealing membrane extending freely from an edge of said at least one free region.

In the following description, it will be considered that the capsule according to the invention is preferably a beverage capsule. However, the invention also encompasses capsules for the preparation of non-liquid food.

Thanks to the provision of the free region of the sealing membrane, leakage from the capsule will be prevented after the extraction of the ingredient therein. Specifically, when the needle of the food or beverage preparation machine pierces the injection wall, the tip of the needle will push the free region of the sealing membrane into the cavity of the capsule as it is inserted. Once the extraction process is complete and the injection needle is withdrawn, the residual pressure within the capsule will force the free region of the sealing membrane against the injection wall. The hole in the injection wall left by the injection needle is thereby sealed, preventing backflow from the hole and maintaining the cleanliness of the machine.

Moreover, this is advantageous in that this effect is achieved by the impetus of the residual pressure within the capsule following the preparation of the food or beverage. No other means for retaining the sealing membrane against the injection wall are necessary to maintain the sealed nature of the hole once the injection needle is removed from the capsule. A capsule incorporating a sealing membrane so configured will operate with an improved degree of cleanliness relative to those known in the art, with minimal additional complexity or cost.

Preferably, the at least one free region constitutes a flap disposed upon a region of the injection wall adapted to be pierced by an injection needle.

This is advantageous in that the sealing membrane will be adapted to the region of the injection wall that can be expected to be pierced by an injection needle. This will conserve material, resulting in a lighter and less expensive food or beverage capsule.

According to a possible feature, the injection wall and sealing membrane are symmetric about an axis normal to said injection wall at a centroid thereof.

This is advantageous in that where the needle of the machine is positioned with the correct radial position, it will pierce the injection wall and deflect a flap of the sealing membrane for any angular position of the capsule. In other words, the positioning of the capsule when inserted into the beverage machine is simplified, obviating the need for notches, keys, or other such positioning means to ensure the correct positioning of the capsule. The capsule incorporating the invention is thereby rendered easier to use.

Preferably, there is provided one fixed region disposed concentrically with the injection wall.

In a practical embodiment, the fixed region of the sealing membrane is disposed proximally to the centroid of the injection wall, the free region of said sealing membrane extending outwardly from said fixed region along a radial direction.

In another practical embodiment, the fixed region of the sealing membrane is disposed along a peripheral edge of said sealing membrane, the free region of said sealing membrane extending towards the centroid of said sealing membrane in a radial direction from said fixed region.

This is advantageous in that providing a single fixed region concentric with the injection wall will simplify the process of positioning and attaching the sealing membrane to the injection wall. Specifically, the use of a single fixed region simplifies the construction and use of the attachment means employed to effectuate the bonding between the injection wall and the sealing membrane.

Alternatively, the fixed region of the sealing membrane is discontinuous along a radial direction, said fixed region being thereby divided into an inner fixed region proximate to said centroid of said sealing membrane, and an outer fixed region proximate to a peripheral edge of said sealing membrane.

In a practical embodiment, the sealing membrane is cut along a path substantially coincident with an edge of the outer fixed region, such that the free region extends from the inner fixed region outwardly in a radial direction.

In another practical embodiment, the sealing membrane is cut along a path substantially coincident with an edge of the inner fixed region, such that the free region extends from the outer fixed region inwardly in a radial direction.

This is advantageous in that providing a plurality of fixed regions will spread the total fixed area of the sealing membrane across the surface of the injection wall. This will result in an injection wall which is uniform in thickness, facilitating the manufacture of beverage capsules on an economical high-speed production line.

It should also be noted that, in embodiments where the flap extends outward from a fixed region, the flap will realize a greater freedom of movement than in other configurations.

In a possible embodiment, the flap of the sealing membrane is configured so as to be biased against the injection wall.

In another possible embodiment, the sealing membrane and the injection wall are provided with opposing electrostatic charges such that an attracting force is generated between them.

This is advantageous in that the flap will remain held against the injection wall even in the absence of pressure within the capsule. The benefits of the invention are thereby realized in applications where the residual pressure within the capsule would not be sufficient to maintain the flap against the injection wall and seal the hole by itself. The range of applications in which a capsule so configured may be used is thereby expanded.

In a practical embodiment, the sealing membrane is fabricated from polypropylene. However, other types of thermoplastic material can be used, such as: polyethylene terephthalate, polyethylene, polystyrene, polyacrylate, polylactic acid, or a combination thereof. These materials can be completed with additional materials such as for instance aluminum, paper or other cellulosic materials, a non-woven material, an adhesive layer, a sealing lacquer, or a combination thereof.

This is advantageous in that polypropylene is durable and resilient, while at the same time lightweight and inexpensive. A polypropylene sealing membrane will resist being pierced by the injection needle and weakened by the heat of the liquid injected to produce the food or the beverage.

In a practical embodiment, the sealing membrane is attached to the injection wall by thermal or ultrasonic welding.

This is advantageous in that thermal and ultrasonic welding will produce a clean, durable joint between the injection wall and the sealing membrane, without requiring the addition of any adhesives or solvents to bond the two.

Alternately, the sealing membrane is attached to the injection wall by adhesive lamination.

This is advantageous in that adhesive lamination achieves a high-speed, continuous bonding of the sealing membrane to the injection wall.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

For a complete understanding of the present invention and the advantages thereof, reference is made to the following detailed description of the invention.

It should be appreciated that various embodiments of the present invention can be combined with other embodiments of the invention and are merely illustrative of the specific ways to make and use the invention, and do not limit the scope of the invention when taken into consideration with the claims and the following detailed description.

Figure 1:
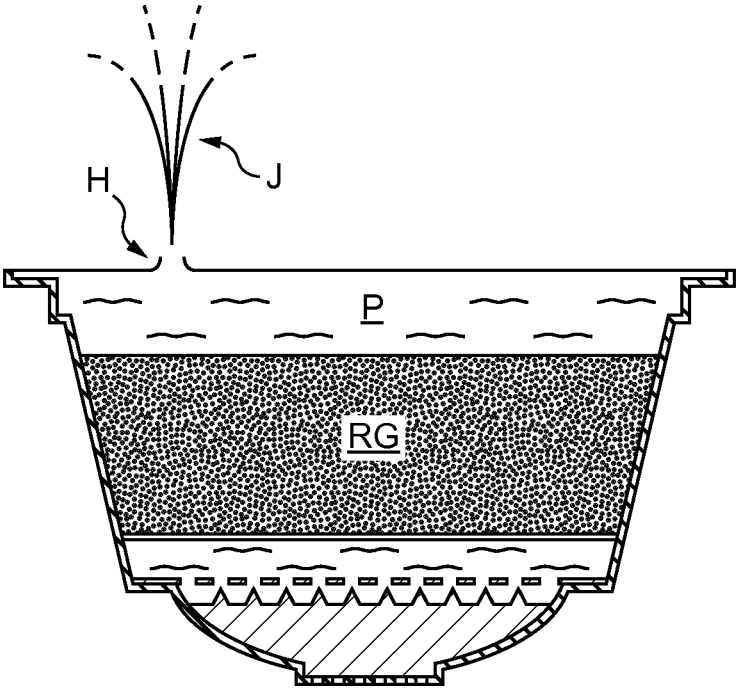
Fig. 1 (prior art)
FIG. 1 is a section view of a beverage capsule as known in the prior art.
Figure 2:
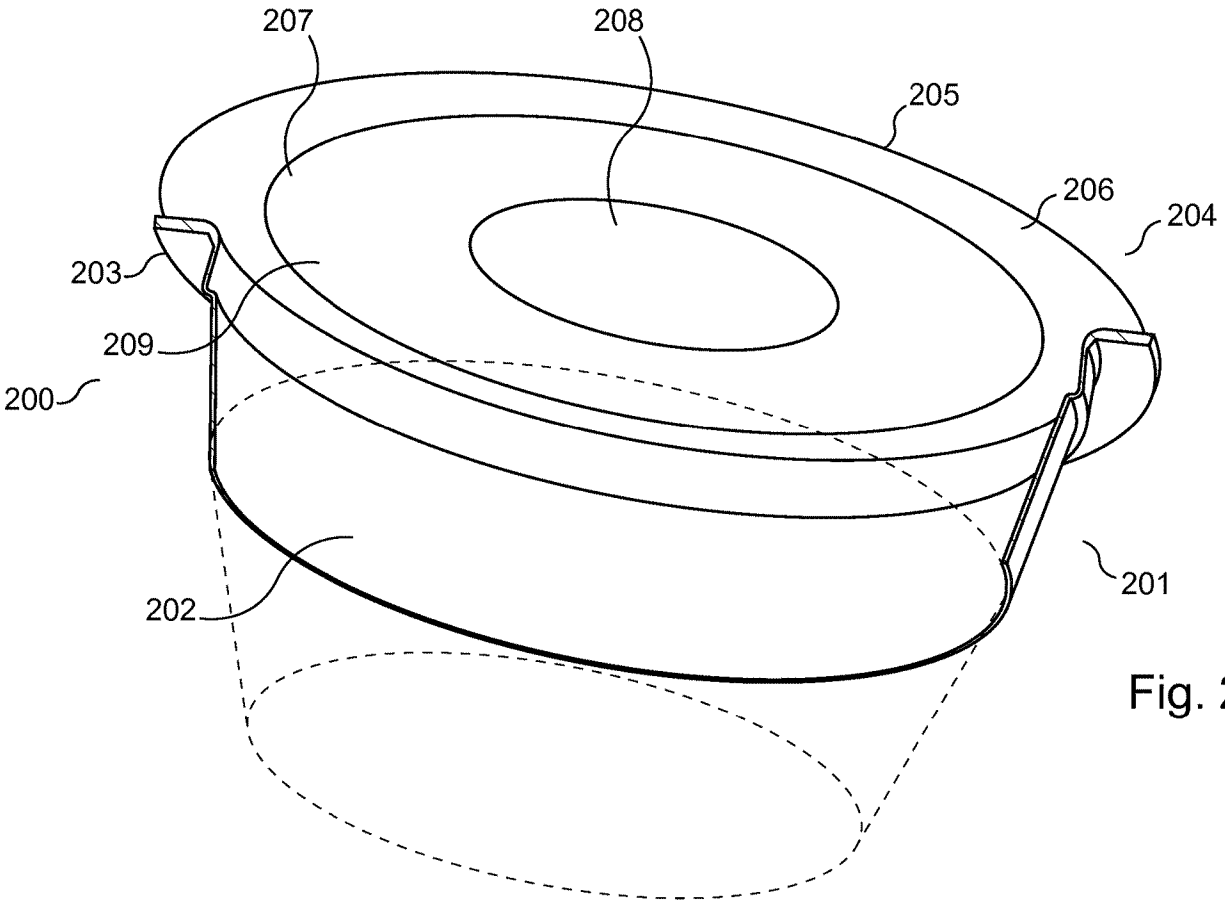
FIG. 2 is a partial section view of a beverage capsule according to a first embodiment of the invention, prior to the insertion of a fluid injection needle.

FIG. 2 is a partial section view of a beverage capsule 200 according to a first embodiment of the invention, prior to the insertion of a fluid injection needle. The beverage capsule 200 is primarily composed of the capsule body 201, here only partially depicted for clarity. The capsule body 201 is substantially cup-shaped, enclosing the cavity 202 into which is disposed a quantity of a beverage ingredient.

The capsule body 201 further comprises a flange 203 disposed at the open end 204 of the beverage capsule 200. To the flange 203 is attached the injection wall 205, which covers the open end 204 and encloses the cavity 202 so as to seal the beverage capsule 200.

The injection wall 205 thereby presents an interior side 206 to the cavity 202 of the beverage capsule 200. The sealing membrane 207 is disposed on this interior side 206, centered upon the injection wall 205 as depicted here. The sealing membrane 207 is affixed to the injection wall 205 over the fixed region 208, which is disposed centrally relative to both the injection wall 205 and the sealing membrane 207. The portion of the sealing membrane 207 which is not within the fixed region 208 is therefore not attached to the injection wall 205, and thus comprises a free region 209. The free region 209 is thus, in this embodiment, configured as an annular region disposed concentrically about the fixed region 208.

The fixed region 208 is a portion of the surface of the sealing membrane 207 which is attached to the injection wall 205. The fixed region 208 may be attached by whichever means are most appropriate for the particular beverage to be produced, for instance by thermal or ultrasonic welding, or pressure-, heat-, or light-sensitive adhesives in a lamination process.

It should be noted that, while in this embodiment the sealing membrane 207 and the fixed region 208 are configured in the form of concentric circles, the sealing membrane and fixed region may be configured in whatever form is most appropriate for the particular application in which it is to be used. In particular, it may be possible to configure the fixed region as a polygonal region and/or offset it from the centroid of the injection wall.

Furthermore, the sealing membrane 207 is fabricated, in this embodiment, from polypropylene. Polypropylene is advantageous in that it can be provided in a form which is lightweight, inexpensive, and resistant to puncture. However, it should be understood that other materials may be employed to fabricate the sealing membrane 207, so long as they are sufficiently flexible and puncture-resistant.

Figure 3:
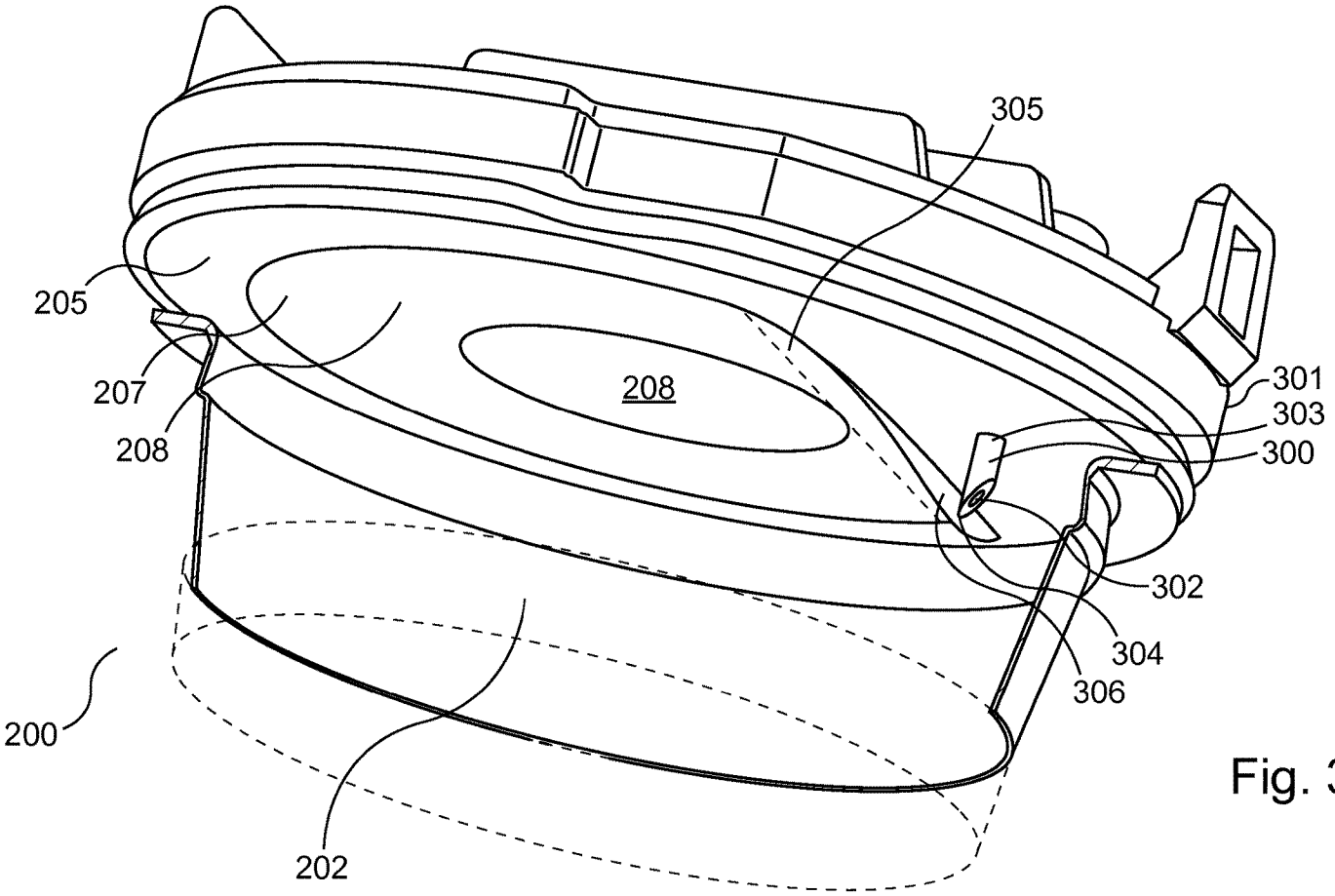
FIG. 3 is a partial section view of the beverage capsule of FIG. 2, after the insertion of a fluid injection needle.

FIG. 3 is a partial section view of the beverage capsule 200, after the insertion of the fluid injection needle 300. The fluid injection needle 300 is fixed to the injection apparatus 301 of a beverage machine, represented here only partially for clarity, and comprises the needle channel 302 through which an injection liquid is introduced to the cavity 202 of the beverage capsule 200.

The positioning of the injection apparatus 301 upon the injection wall 207 forces the injection needle 300 through the injection wall 205, piercing it at the hole 303. As the injection needle 300 is advanced, the tip 304 will push the sealing membrane 208 at the free region 209, causing it to bend backwards along the break line 305 and form the flap 306.

It should be noted that the size and location of the flap 306 are a function of the location of the hole 303 on the injection wall 205 and the depth to which the injection needle 300 is advanced. Similarly, the break line 305 is not a fixed location on the sealing membrane 208, but merely the line along which the sealing membrane 208 happens to separate from the injection wall 205 and form the flap 306. The injection needle 300 may thus be inserted into the injection wall 205 at any point corresponding to the free region 209, simplifying the positioning of the beverage capsule 200 in relation to the injection apparatus 301.

Figure 4A:
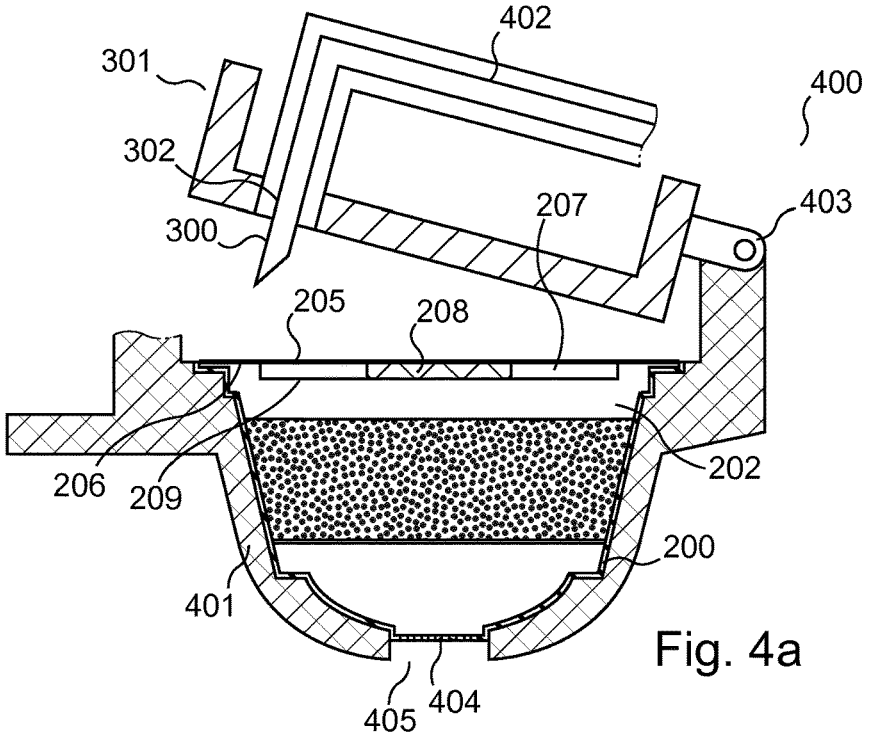
FIG. 4A is a side section view of the beverage capsule of FIG. 2 as disposed within a beverage machine, prior to the insertion of an injection needle.
Figure 4B:
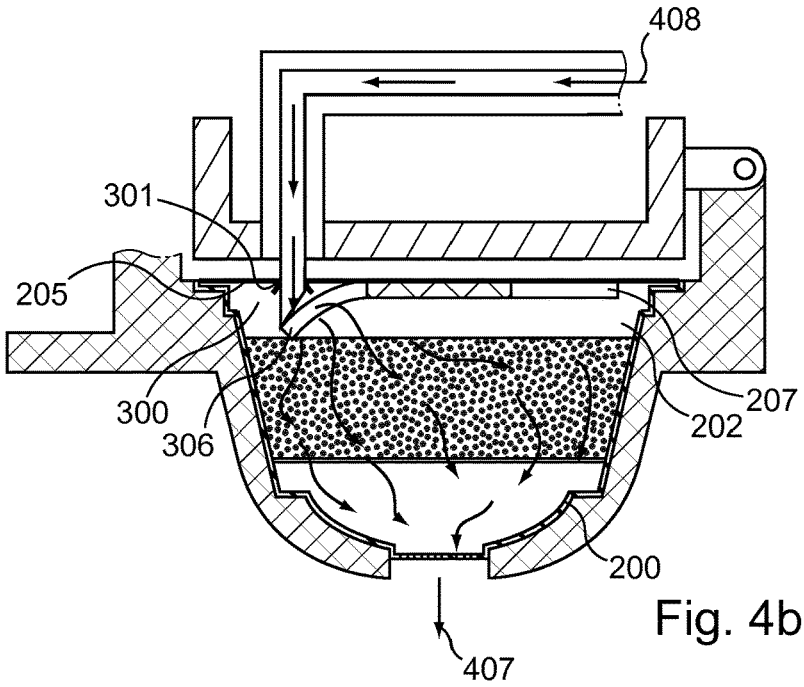
FIG. 4B is a side section view of the beverage capsule of FIG. 2 as disposed within a beverage machine, during a step for the injection of a liquid.
Figure 4C:
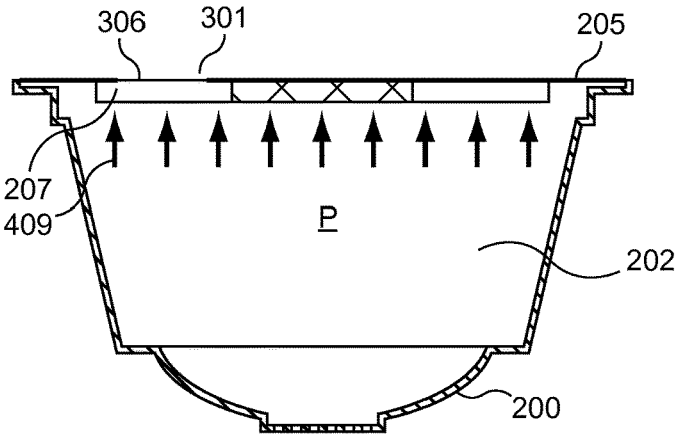
FIG. 4C is a side section view of the beverage capsule of FIG. 2 after a step for the injection of a liquid.

FIGS. 4A, 4B, & 4C depict the operation of the flap 306 before, during, and after the injection of a liquid into the beverage capsule 200. Each of these three figures will be discussed in turn.

FIG. 4A depicts the beverage capsule 200 as disposed in a beverage machine 400, prior to the injection of a liquid. The beverage machine 400, here simplified for illustrative purposes, comprises the injection apparatus 301 and the capsule receptacle 401.

The injection apparatus 301 comprises the injection needle 300, the needle channel 302 of which is connected via the supply line 402 to a supply of injection liquid (not shown). The injection apparatus is attached to the capsule receptacle by way of the hinge 403, which permits the injection apparatus 301 to pass from an open position, depicted here, to a closed position as depicted in FIG. 4B.

The capsule receptacle 401 is substantially cup-shaped, configured to accommodate the beverage capsule 200 therein and maintain it in a fixed position. The beverage capsule 200 is provided with a drain 404 which permits the finished beverage to drain from the beverage capsule 200 through a corresponding gap 405 in the capsule receptacle 401. The cavity 202 of the beverage capsule 200 is filled with a beverage ingredient 406, which is used to produce a beverage in an injection step.

The sealing membrane 207 is attached over the fixed region 208 to the interior side 206 of the injection wall 205. In this embodiment, the elasticity of the sealing membrane 205 causes the free region 209 thereof to remain flush against the interior side 206 of the injection wall 205 until the injection needle 300 is inserted into the beverage capsule 200.

FIG. 4B depicts the beverage capsule 200 during the preparation of a beverage 407. The injection apparatus 301 has been disposed into the closed position as shown here, the injection needle 300 piercing the injection wall 205 at the hole 301 and protruding into the cavity 202 of the beverage capsule 200.

The injection needle 300 pushes on the sealing membrane 207, displacing the flap 306. During the preparation of the beverage 407, the injection liquid 408 is introduced into the cavity 202 of the beverage capsule 200 through the injection needle 300. The injection liquid 408 flows past the flap 306, mixing with the beverage ingredient 306 and issuing from the capsule as the beverage 407.

FIG. 4C depicts the beverage capsule 200 after the preparation of the beverage, having been removed from the beverage machine. The residual pressure P within the cavity 200 of the beverage exerts a force 409 upon the sealing membrane 207, causing the flap 306 to lie flush against the injection wall 205. This blocks the hole 301 and prevents leakage of any residual beverage through it.

In this embodiment, the main factor maintaining the flap 306 against the injection wall 205 is the force 409 generated by the residual pressure P. However, it may be advantageous to provide additional means for holding the sealing membrane against the injection wall 205. For instance, the elasticity of the sealing membrane itself may contribute an amount of force, or the sealing membrane and injection wall may be provided opposing electrostatic charges so as to generate an attractive force between the two.

Figure 5A:
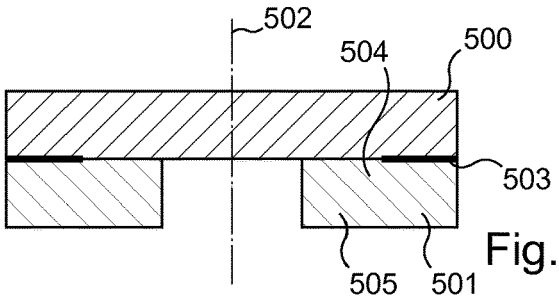
FIGS. 5A, 5B, and 5C are schematic representations of the injection wall and sealing membrane according to a second, third, and fourth embodiment, respectively.
Figure 5B:
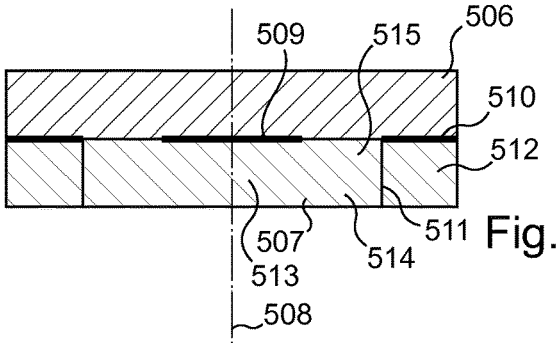
Figure 5C:
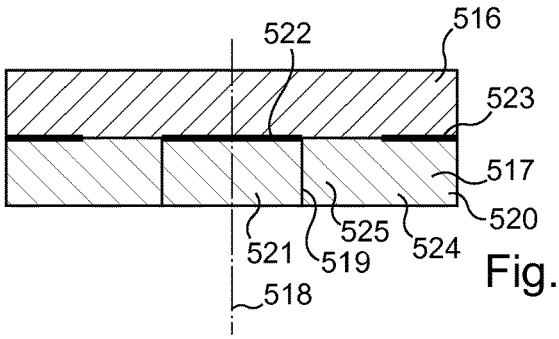

FIGS. 5A, 5B, and 5C are schematic depictions of alternate configurations for the sealing membrane and the fixed regions. In all three figures, the thickness of the injection wall and sealing membrane are exaggerated for purposes of clarity.

FIG. 5A depicts a section view of an injection wall 500 and sealing membrane 501 according to a second embodiment. As in the previous embodiment, the injection wall 500 and sealing membrane 501 are provided in a circular form; the view presented in this Figure is thus a section through a plane passing through the centerline 502 about which the assembly herein depicted is symmetrical.

The embodiment depicted here in FIG. 5A is similar to the one presented in the previous Figures, in that there is provided a single, continuous fixed region 503. The fixed region 503 is provided at a peripheral edge of the sealing membrane 501, being thereby configured in an annular shape. The sealing membrane is cut so as to remove the portion proximal to the centerline 502, the remaining free region 504 of the sealing membrane 201 thereby forming an annular flap 505. The annular flap 505 opens inwardly, such that the liquid issuing from an injection needle will be directed towards the center of the beverage capsule.

FIG. 5B depicts a section view of an injection wall 506 and a sealing membrane 507 according to a third embodiment. As in the previous embodiments, the injection wall 506 and sealing membrane 507 are circular in form, the resulting assembly being symmetric about the centerline 508.

In this embodiment, the fixed region is discontinuous, comprising a central fixed region 509 and a peripheral fixed region 510. The sealing membrane is cut along a circular cutting line 511, dividing it into an annular, peripheral segment 512 and a circular, central segment 513.

The peripheral segment 512 is entirely within the peripheral fixed region 510, and thus is immobile. However, the central segment 513 is larger in diameter than the central fixed region 509, such that the portion of the central segment 513 not corresponding to the central fixed region 509 forms the free region 514.

The free region 514 thus serves as an annular flap 515 during the preparation of a beverage. Since the free region 514 extends outwardly from the central fixed region 509 to the cutting line 511, the resulting annular flap 515 will open outwardly upon the insertion of an injection needle into the beverage capsule.

Furthermore, the provision of the fixed, annular peripheral segment 512 will maintain a uniform thickness over the surface of the assembly. This is particularly advantageous in that it facilitates the storage, transport, and use of the injection wall 506/sealing membrane 507 assembly in a mass-production setting.

FIG. 5C depicts a section view of an injection wall 516 and a sealing membrane 517 according to a third embodiment. As in the previous embodiments, the injection wall 516 and the sealing membrane 517 are symmetric about the centerline 518.

As in the previous embodiment, the sealing membrane 517 is cut along a cutting line 519. The cutting line 519 separates the sealing membrane 517 into an annular, peripheral segment 520 and a circular, central segment 521. Furthermore, the sealing membrane 517 is affixed to the injection wall 516 over two fixed regions: the central fixed region 522 and the peripheral fixed region 523.

The central fixed region 522 is substantially the same diameter as the central segment 521 of the sealing membrane 517. Because of this, the central segment 521 is held in place. The peripheral fixed region 523 is disposed along the peripheral edge of the injection wall 516, such that the peripheral segment 520 of the sealing membrane 517 extends from the inner edge of the peripheral fixed region 523 in the form of an annular, free region 524.

The free region 524 thus serves as the flap 525 of the sealing membrane 517. The orientation of the flap 525 will ensure that the liquid injected through the injection wall 516 will be directed towards the center of the beverage capsule, while the presence of the central segment 521 at the central fixed region 522 ensures that the thickness of the injection wall 516/sealing membrane 517 assembly is uniform across its surface.

Of course, it should be well understood that the configuration of the sealing membrane, the fixed and free regions, and the orientations of the resulting flaps need not necessarily be circular or symmetric as in the foregoing embodiments. Furthermore, the fixed regions need not necessarily be positioned at the center or edge of the injection wall or sealing membrane, but may in fact be positioned anywhere upon the surface of the sealing membrane. In fact, the sealing membrane and the free and fixed regions may be configured in whatever format is optimal for the particular application in which they are to be employed, including asymmetrical and irregular arrangements. The foregoing embodiments should be therefore taken as purely exemplary, and not in any way as describing a more effective configuration or preferred embodiment of the invention. For instance, the flap sealing membrane is not necessarily circular (axisymmetric) as described above and shown in the drawing. It could also be asymmetrical, as long as it comprises one attachment portion to the capsule injection wall, and one free portion that flexes to bring the sealing effect described above.

The flap layer can be manufactured out of any suitable polymer that can be transformed into a film, such as—but not limited to: polyethylene, polypropylene, polystyrene, polyethylene terephthalate, polylactic acid; polyvinylchloride, polyvinylidene chloride, aluminum, paper, non-woven polymeric films, or a combination thereof. The material can be completed with suitable additives such as minerals (e.g. calcium carbonate, titanium oxide, charcoal salts or black carbon).

Moreover, it should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A food or beverage capsule, comprising:

a capsule body comprising a cavity and an open end in communication with the cavity;

an injection wall located upon the open end so as to close the cavity, the injection wall thereby comprising an interior side facing the cavity;

a quantity of a food or beverage ingredient located within the cavity;

the capsule further comprises a sealing membrane fabricated from a flexible material and located upon the interior side of the injection wall, the sealing membrane being attached to the interior side of the injection wall over at least one fixed region of the sealing membrane, at least one free region of the sealing membrane extending freely from an edge of the at least one fixed region; wherein the at least one free region constitutes a flap located upon a region of the injection wall adapted to be pierced by an injection needle; and wherein the flap comprises a first end integral with the at least one fixed region, the flap further comprises a second end at which the sealing membrane terminates, the remainder of the flap is the only component of the capsule to which the second end of the flap is fixedly attached.

2. The capsule according to claim 1, wherein the flap of the sealing membrane is biased against the injection wall.

3. The capsule according to claim 1, wherein the injection wall and the sealing membrane are symmetric about an axis normal to the injection wall at a centroid thereof.

4. The capsule according to claim 1, wherein the at least one fixed region is a single fixed region disposed concentrically with the injection wall.

5. The capsule according to claim 4, wherein the single fixed region of the sealing membrane is located proximally to the centroid of the injection wall, the at least one free region of the sealing membrane extending outwardly from the single fixed region along a radial direction.

6. The capsule according to claim 4, wherein the single fixed region of the sealing membrane is located along a peripheral edge of the sealing membrane, the at least one free region of the sealing membrane extending towards the centroid of the sealing membrane from the single fixed region.

7. The capsule according to claim 1, wherein the at least one fixed region is a plurality of fixed regions comprising at least a central fixed region located proximally to the centroid of the sealing membrane and a peripheral fixed region located along a peripheral edge of the sealing membrane.

8. The capsule according to claim 7, wherein the sealing membrane is cut along a path substantially coincident with an edge of the peripheral fixed region, such that the at least one free region extends from the central fixed region outwardly in a radial direction.

9. The capsule according to claim 7, wherein the sealing membrane is cut along a path substantially coincident with an edge of the central fixed region, such that the at least one free region extends from the peripheral fixed region inwardly in a radial direction.

10. The capsule as claimed in claim 1, wherein the sealing membrane and the injection wall are provided with opposing electrostatic charges such that an attracting force is generated between them.

11. The capsule as claimed in claim 1, wherein the sealing membrane is fabricated from polypropylene.

12. The capsule as claimed in claim 1, wherein the sealing membrane is attached to the injection wall by thermal or ultrasonic welding.

13. The capsule as claimed in claim 1, wherein the sealing membrane is attached to the injection wall by adhesive lamination.

14. The capsule according to claim 1, wherein the flap is configured for the second end to (i) abut the injection wall in an initial position of the second end, (ii) then extend into the cavity when the flap is pushed by an injection needle piercing the injection wall, and (iii) then return to the initial position when the injection needle is withdrawn.

15. The capsule according to claim 1, wherein the at least one free region comprises a thermoplastic material.

* * * * *